US009546581B2

(12) United States Patent
Müller

(10) Patent No.: US 9,546,581 B2
(45) Date of Patent: Jan. 17, 2017

(54) MUFFLER FOR AN EXHAUST SYSTEM

(71) Applicant: Eberspächer Exhaust Technology GmbH & Co. KG, Neunkirchen (DE)

(72) Inventor: Frank Müller, Esslingen (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 0 days.

(21) Appl. No.: 14/836,044

(22) Filed: Aug. 26, 2015

(65) Prior Publication Data

US 2016/0061074 A1 Mar. 3, 2016

(30) Foreign Application Priority Data

Aug. 27, 2014 (DE) ..... 10 2014 217 058

(51) Int. Cl.

| | |
|---|---|
| ***F01N 1/02*** | (2006.01) |
| ***F01N 1/04*** | (2006.01) |
| ***F01N 1/24*** | (2006.01) |
| ***F01N 1/10*** | (2006.01) |
| *F01N 1/00* | (2006.01) |

(52) U.S. Cl.

CPC ..... *F01N 1/10* (2013.01)

(58) Field of Classification Search

CPC ..... F01N 1/003; F01N 1/026; F01N 1/04; F01N 1/10; F01N 1/24

USPC ..... 181/256, 252, 269, 272, 273, 276, 282,181/281, 266, 270

See application file for complete search history.

(56) References Cited

U.S. PATENT DOCUMENTS

| | | | | | |
|---|---|---|---|---|---|
| 3,375,898 | A * | 4/1968 | Von Hoevel | F01N 1/10 | 181/238 |
| 4,073,361 | A * | 2/1978 | Murota | F01N 3/26 | 181/228 |
| 4,290,501 | A * | 9/1981 | Tanaka | F01N 1/084 | 181/228 |
| 4,416,350 | A * | 11/1983 | Hayashi | F01N 1/02 | 181/265 |
| 4,598,790 | A * | 7/1986 | Uesugi | F01N 1/10 | 181/252 |
| 4,971,166 | A * | 11/1990 | Hase | F01N 1/02 | 181/254 |

(Continued)

FOREIGN PATENT DOCUMENTS

| | | | | |
|---|---|---|---|---|
| FR | 2233872 A5 * | 1/1975 | ..... | F01N 1/10 |
| JP | 02169812 A * | 6/1990 | | |
| JP | 02238115 A * | 9/1990 | | |

*Primary Examiner* — Edgardo San Martin

(74) *Attorney, Agent, or Firm* — McGlew and Tuttle, P.C.

(57) ABSTRACT

A muffler (1) for an exhaust system of a motor vehicle internal combustion engine has a housing (2), with an exhaust gas inlet (4) and an exhaust gas outlet (5), including a circumferentially extending jacket (16) and end panels (14, 15) each axial ends. A chamber (18) in the housing interior (3), through which exhaust gas flows during operation, is axially limited by intermediate panels (20, 21) at axial ends. The thermal load on the jacket (16) is reduced with an insulating shell (29), arranged in the housing interior, extending in the circumferential direction (17) along the jacket (16). The two intermediate panels (20, 21) are supported on the insulating shell (29), each with an outer panel edge (30, 31). The insulating shell (29) is supported radially on the jacket (16) with a shell edge (33). An insulating gap (35) is formed radially between the jacket and the insulating shell.

15 Claims, 2 Drawing Sheets

(56) References Cited

U.S. PATENT DOCUMENTS 5,168,132 A * 12/1992 Beidl ..... F01N 1/02 181/265
5,206,467 A * 4/1993 Nagai ..... F01N 1/10 181/232
5,220,137 A * 6/1993 Howerton ..... F01N 1/089 181/264
5,783,782 A * 7/1998 Sterrett ..... F01N 1/02 181/256
5,912,441 A * 6/1999 Worner ..... F01N 1/06 181/256
5,969,299 A * 10/1999 Yamaguchi ..... F01N 1/089 181/227
6,394,225 B1 * 5/2002 Yasuda ..... F01N 1/084 181/256
6,941,751 B2 * 9/2005 Yamamoto ..... F01N 1/083 181/231
7,004,283 B2 * 2/2006 Worner ..... F01N 1/02 181/239
7,156,710 B2 * 1/2007 Yokoya ..... B63H 21/32 440/89 J
7,464,789 B2 * 12/2008 Yamamoto ..... F01N 1/089 181/212
7,562,741 B2 * 7/2009 Winklel ..... F01N 13/02 181/239
7,617,909 B2 * 11/2009 Wolf ..... F01N 1/083 181/269
7,694,778 B2 * 4/2010 Toyoshima ..... F01N 1/084 181/212
8,091,683 B2 * 1/2012 Tabata ..... F01N 1/00 181/227
8,205,713 B2 * 6/2012 Gorke ..... F01N 13/1838 181/212
8,205,716 B2 * 6/2012 Wirth ..... F01N 1/08 181/212
8,418,805 B1 * 4/2013 Han ..... F01N 13/1888 181/212
8,579,077 B2 * 11/2013 Ahn ..... F01N 13/08 181/212
8,684,131 B1 * 4/2014 Park ..... F01N 1/04 181/228
8,851,230 B2 * 10/2014 Ono ..... F01N 1/089 180/219
2006/0081416 A1 * 4/2006 Nentrup ..... F01N 1/24 181/256
2008/0196969 A1 * 8/2008 Henke ..... F01N 1/08 181/212
2016/0053642 A1 * 2/2016 Hiraoka ..... F01N 13/082 181/256

* cited by examiner

MUFFLER FOR AN EXHAUST SYSTEM

CROSS REFERENCE TO RELATED APPLICATIONS

This application claims the benefit of priority under 35 U.S.C. §119 of German Patent Application 10 2014 217 058.3 filed Aug. 27, 2014, the entire contents of which are incorporated herein by reference.

FIELD OF THE INVENTION

The present invention pertains to a muffler for an exhaust system of an internal combustion engine, especially of a motor vehicle.

BACKGROUND OF THE INVENTION

Such a muffler usually comprises a housing, which has at least one exhaust gas inlet and at least one exhaust gas outlet, which are fluidically connected with one another in the interior of the housing, which is enclosed by the housing. At its axial ends, the usually cylindrical housing has an end panel each, which axially limit the housing interior. Further, a jacket, which extends circularly in the circumferential direction and limits the housing interior radially, is provided. Further, at least one chamber, through which exhaust gas flows during the operation of the exhaust system and which is limited axially by an intermediate panel each at its axial ends, may be formed in the housing interior, said intermediate panel being located at an axially spaced location from the two end panels. Such a chamber may be, for example, a reflection chamber, in which disturbing noises can be muffled by reflection effects in a predetermined frequency range. The terms "axial," "radial" and "circumferential direction" refer to a central longitudinal axis of the housing.

Mufflers may be designed in an exhaust system of an internal combustion engine as front mufflers or as middle mufflers or as end mufflers. An end muffler is usually followed directly on the outlet side by a so-called tail pipe of the exhaust system. In vehicle applications, the tail pipe is usually located at the rear of the vehicle. Further, it may be practical for reasons of installation space to arrange such an end muffler transversely at the rear of the vehicle, i.e., such that its central longitudinal axis extends essentially at right angles to the longitudinal axis of the vehicle. Installation situations in which there is only a relatively short distance between the housing of the muffler and heat-sensitive components of the vehicle may occur now. It was found in this connection that a large amount of heat is radiated from the jacket especially in the area of chambers through which exhaust gas flows, which may lead to damage to the heat-sensitive components located in the area surrounding the housing. Further, it was observed that a discoloration of the housing may develop preferably in the area of a support of the intermediate panels at the jacket. However, such a discoloration of the housing is undesired especially in case of a housing arranged in a visible manner. To avoid such a heat radiation into the area surrounding the muffler as well as to reduce the risk of a discoloration of the housing, it is possible, in principle, to design the jacket as a double-walled jacket, so that a cavity, which may be filled with a suitable heat-insulating insulating material, develops between an inner wall and an outer wall of the jacket. However, it is relatively expensive to equip the housing with such a heat-insulating, double-walled jacket.

SUMMARY OF THE INVENTION

An object of the present invention is to provide an improved embodiment for a muffler of the type mentioned in the introduction, which is characterized especially in that an undesired radiation of heat into the surrounding area as well as the risk of a discoloration are reduced with a design having a reasonable cost.

The present invention is based on the general idea of arranging an insulating shell in the housing interior in the area of the chamber through which exhaust gas flows, doing so such that the intermediate panels assigned to this chamber are no longer supported radially in the area of this insulating shell on the jacket but on said insulating shell, which is, in turn, supported radially on the jacket. Further, the insulating shell is supported radially on the jacket such that an insulating gap is formed radially between the jacket and the insulating shell outside of this support. A direct contact between the partitions and the jacket is avoided by this mode of construction in the area of the insulating shell, because the partitions are supported on the insulating shell. Since the insulating shell is, in turn, supported on the jacket, there is only an indirect support on the jacket for the partitions in the area of the insulating shell, namely, via the insulating shell. The present invention takes advantage of the discovery that mainly the intermediate panels, which transfer the heat to the respective radial support point via their outer panel edge, are heated during the flow of exhaust gas through the chamber. Due to the intermediate panels being supported on the insulating shell, the heat transfer takes place at first into the insulating shell, as a result of which the direct admission of heat to the jacket is significantly reduced in the area of the insulating shell. The jacket itself is also no longer exposed directly to the hot exhaust gases in the area of the insulating shell, so that the thermal load on the jacket is reduced in this respect in the area of the insulating shell. It was found that the temperatures on the jacket can be significantly reduced in the area of the chamber due to the arrangement of such an insulating shell, as a result of which the risk of a discoloration of the jacket is reduced, on the one hand, while the radiation of heat into the surrounding area is reduced, on the other hand.

Specifically, the present invention proposes that the two intermediate panels be supported each with a radially outer panel edge radially on a panel support area of the insulating shell, while the insulating shell itself is supported on the jacket radially with a shell edge. Further, an insulating gap, which is limited at least axially by the shell edge, is formed radially between the jacket and the insulating shell. The shell edge itself may be preferably supported on the jacket outside the respective panel support area, so that a jacket support area is arranged axially offset in relation to the panel support area. In particular, the jacket support area is also offset axially in relation to the chamber, i.e., it is offset in the direction of the respective end panel in relation to the intermediate panels. In particular, the respective jacket support area is offset hereby into an adjacent chamber which may be arranged in the housing interior axially in relation to the chamber, through which exhaust gas flows. Especially advantageous is an embodiment in which the respective chamber that is axially adjacent to the chamber through which flow takes place is not flown through by exhaust gas during the operation of the exhaust system. Such chambers without flow through them are, for example, absorption chambers or resonance chambers of a Helmholtz resonator.

The terms "axial" and "radial" as well as "circumferential direction" refer in this connection to a central longitudinal axis of the housing, which may have especially a cylindrical or cuboid shape.

The muffler is preferably an end muffler. It is clear that an embodiment as a front muffler or as a middle muffler may also be provided. The muffler may be manufactured as a winding construction, a shell construction or a barrel construction. The muffler may be designed for transverse installation, so that the respective exhaust gas inlet is arranged radially, i.e., on the jacket, while the respective exhaust gas outlet is arranged axially, i.e., on one of the end panels.

Corresponding to an advantageous embodiment, the insulating shell may be located at an axially spaced location from both end panels. The insulating shell thus extends fully within the housing. At the same time, a tight connection between the end panels and the jacket is also simplified thereby.

The insulating shell may extend, in principle, over 360° in the circumferential direction, i.e., in a fully closed form. However, an embodiment in which the insulating shell extends in the circumferential direction over less than 360° is preferred. The insulating shell preferably extends in the circumferential direction over a maximum of 180° or over a maximum of 120° or over a maximum of 90°. This embodiment is based on the consideration that it is sufficient for protecting a component arranged in the closer area surrounding the muffler from overheating to reduce the radiation of heat from the jacket in the circumferential section only which said component adjoins. As a result, a greater radiation of heat may be achieved in the remaining circumference, as a result of which the heating of the housing can be reduced. If the insulating shell is not closed fully in the circumferential direction, the insulating gap may have open ends or closed ends in the circumferential direction. Closed ends may be embodied, for example, by the insulating shell being supported on the jacket radially via the shell edge in the area of its circumferential ends, as a result of which the insulating gap is also limited by the shell edge in the circumferential direction.

Corresponding to an advantageous variant, provisions may be made for the two intermediate panels with their respective panel edge to be supported radially on the inner shell in a shell section and radially directly on the jacket in a jacket section. The insulating shell is thus structurally integrated in the design of the housing, such that the intermediate panels are supported on the insulating shell in the circumferential section in which heat insulation is desired, while they are supported on the jacket in the remaining circumferential section. Since only a partial area of the jacket and especially only one circumferential section of the jacket are protected from heat by means of the insulating shell, the muffler according to the present invention can be manufactured at a relatively low cost. Further, the integration of the insulating shell is also associated only with a relatively small increase in weight.

According to another advantageous variant, the respective intermediate panel may have at least one step in the area of at least one transition between the shell section and the jacket section, in which step the shell section passes through the respective intermediate panel. It is possible hereby to embody the support of the insulating shell on the jacket without interruption in the area of the respective intermediate panel as well. In particular, the insulating gap can be separated as a result sufficiently tightly from the rest of the interior of the housing.

In another variant, the shell edge may have at least one interruption in the area of at least one such intermediate panel, in which interruption the respective intermediate panel extends up to the jacket and is supported radially in the jacket section with the panel edge at the jacket. An interruption of the support between the insulating shell and the jacket is accepted in this variant in the area of the shell edge in order to improve the support of the intermediate panel on the jacket and/or on the inner shell in the area of the transition between the shell section and the jacket section.

According to another advantageous embodiment, the shell edge may have two circumferential sections extending in the circumferential direction and two axially extending axial sections, which connect the two circumferential sections to one another. In particular, it can be achieved hereby that the shell edge is shaped extending circumferentially on the insulating shell in a closed form. The insulating gap is more or less encapsulated against the rest of the interior of the housing in case of a shell edge extending circumferentially in a closed form.

In another advantageous embodiment, the shell edge may be shaped in profile such that a linear contact is obtained between the shell edge and the jacket. In particular, the shell edge may be designed with a U-shaped or S-shaped profile in order to generate such a linear contacting. Such a linear contact is obtained when the profile is curved convexly towards the jacket in the particular cross section, while the jacket is plane or straight. A punctiform contact, which leads to the desired linear contact between the shell edge and the jacket along the shell edge, is thus obtained in the cross section. Such a linear contact reduces the heat transfer between the insulating shell and the jacket, so that the risk of overheating with a discoloration and the like on the jacket is reduced.

In another advantageous embodiment, the chamber, through which the exhaust gas flows, may be designed as a reflection chamber or as an expansion chamber, in which a feed line, through which exhaust gas enters the chamber during the operation of the exhaust system, has an open outlet end and in which a discharge line, through which exhaust gas leaves the chamber during the operation of the exhaust system, has an open inlet end. Said chamber may also be designed as a combined reflection and expansion chamber. The limiting walls of such reflection and/or expansion chambers may be exposed to a high thermal load during the operation of the exhaust system, which takes place due to a direct admission of the hot exhaust gases to these limiting walls. Due to the integration of the insulating shell in the area of this reflection and/or expansion chamber, the insulating shell forms at least a part of such a limitation, as a result of which the jacket is relieved of thermal load in the area of the insulating shell.

In another embodiment, the exhaust gas inlet may open through the jacket into the chamber. The chamber is exposed to an especially high thermal load in this way.

According to a variant, the exhaust gas inlet, which opens through the jacket into the chamber, may be arranged essentially opposite the insulating shell. In particular, the insulating shell is arranged essentially diametrically opposite the exhaust gas inlet. The exhaust gas inlet is preferably connected to the jacket such that a direction of inflow, with which the exhaust gas flows into the chamber through the exhaust gas inlet during the operation of the exhaust system, is directed towards the insulating shell, so that the exhaust gas flow entering the chamber reaches the insulating shell at least in the core. This results in an especially high efficiency for the thermal protective effect of the insulating shell.

Provisions may be made according to another advantageous variant for the exhaust gas inlet to pass through the jacket in the area of the jacket sections of the intermediate panels. Provisions are made in this embodiment, on the one hand, for the insulating shell not to extend fully, i.e., to extend over less than 360°, in the circumferential direction. On the other hand, provisions are made here for the jacket to be connected to the shell in its remaining circumferential section at a spaced location from the insulating shell, i.e., in the circumferential direction. The connection of the exhaust gas inlet to the housing is simplified thereby.

The insulating gap may, in principle, be free from any special filling, so that it is filled with air and/or exhaust gas. As a result, the insulating gap acts essentially as an air gap insulation. Evacuation of the insulating gap may also be provided. The shell edge is designed for this as a closed, circumferential shell edge and is tightly connected to the jacket, and is especially soldered and/or welded to the jacket. The heat transfer is significantly reduced by the provision of a vacuum in the insulating gap.

In another embodiment, an insulating material may be arranged in the insulating gap. Compared to an evacuation of the insulating gap, the use of an insulating material is relatively inexpensive. A suitable insulating material is, for example, a fiber material. Provisions may be made, in particular, for the insulating gap to be filled essentially with the insulating material, as a result of which the insulating effect is optimized.

A plurality of fixing sections, which mesh with the insulating material without touching the jacket, may be bent out on the insulating shell in another variant. The relative position of the insulating material within the insulating gap can be fixed by means of these fixing sections. The bent-out fixing sections are formed integrally in one piece with the insulating shell. The fixing sections are cut free for this from the rest of the body of the insulating shell along a part of the circumference of the insulating shell and bent over in the area of the remaining circumferential section relative to the rest of the body of the insulating shell such that they protrude into the insulating gap. The fixing sections for fixing the insulating material can thus be formed on the insulating shell in an especially simple and inexpensive manner.

In another embodiment, the intermediate panels may be welded to the insulating shell, while the insulating shell is supported loosely on the jacket. Especially a barrel design, in which a functional insert comprising the intermediate panels and the insulating shell is inserted axially into the jacket shaped into a tube, can be obtained thereby for the muffler.

Further important features and advantages of the present invention appear from the subclaims, from the drawings and from the corresponding description of the figures on the basis of the drawings.

It is apparent that the above-mentioned features, which will also be explained below, may be used not only in the particular combination indicated, but in other combinations or alone as well, without going beyond the scope of the present invention.

Preferred exemplary embodiments of the present invention are shown in the drawings and will be explained in more detail in the following description, where identical reference numbers designate identical or similar or functionally identical components. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
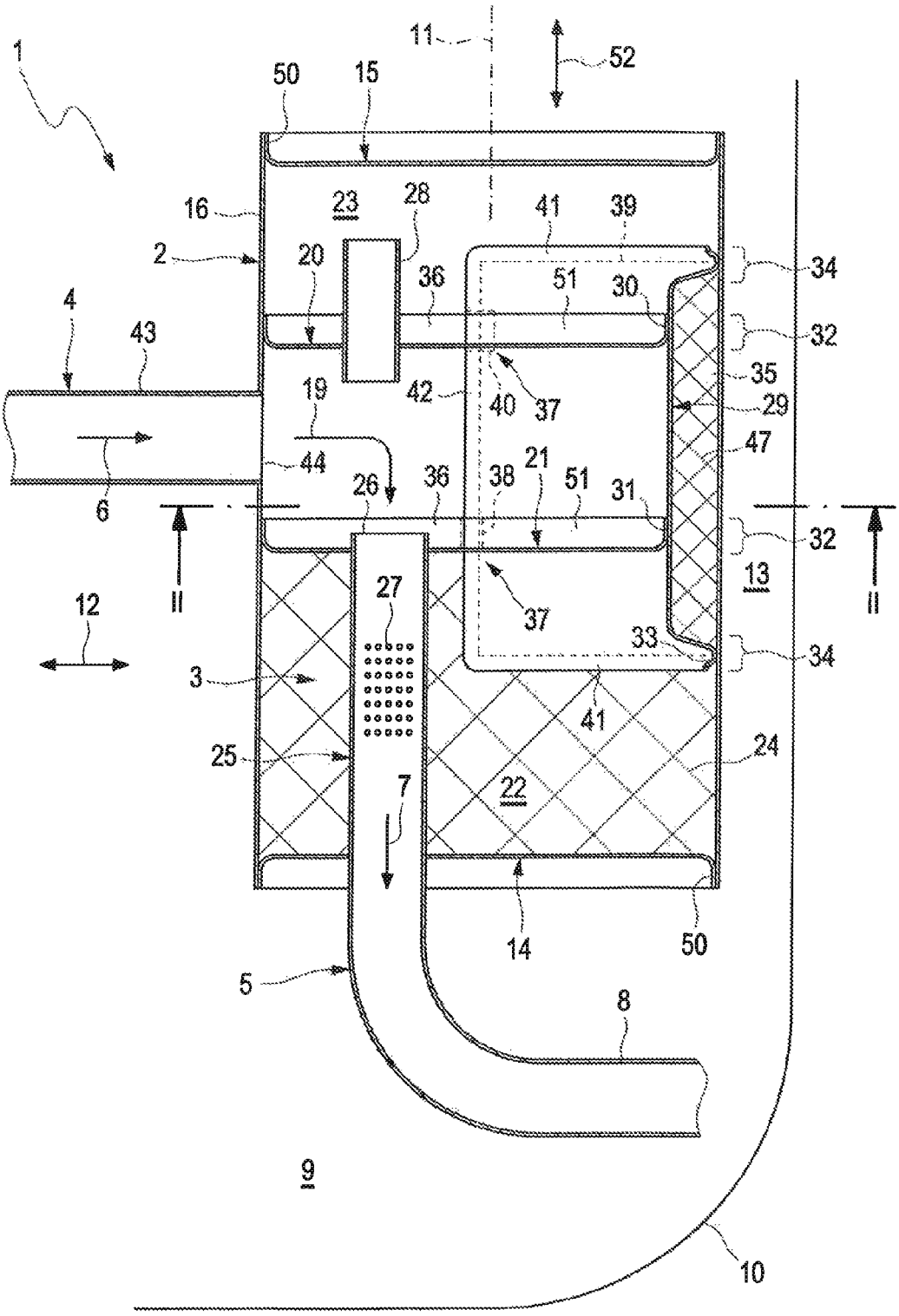
FIG. 1 shows a highly simplified longitudinal section of a muffler.
Figure 2:
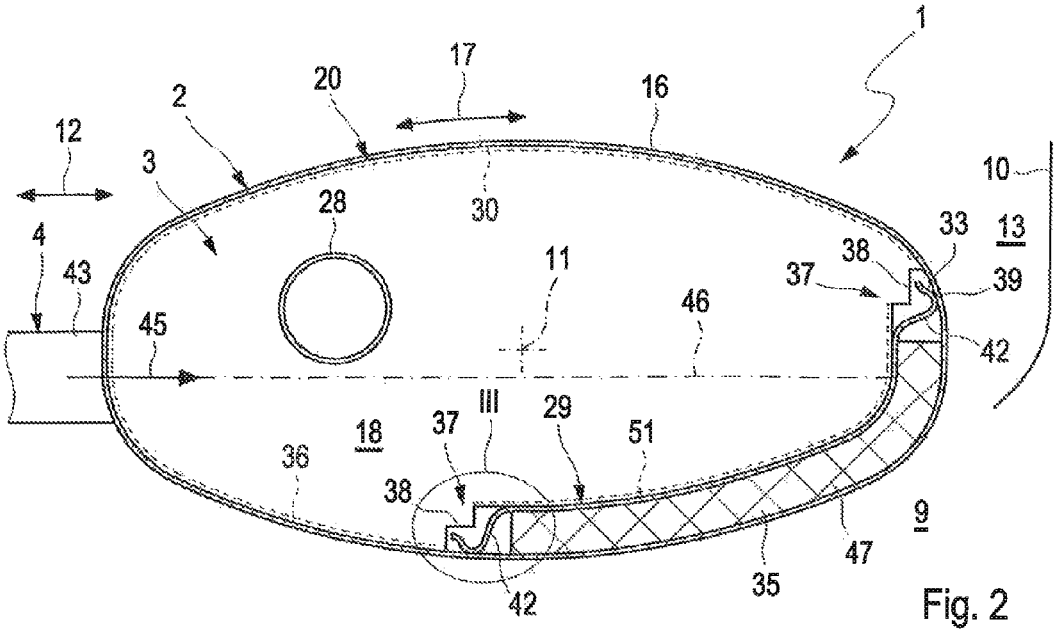
FIG. 2 shows a highly simplified cross section of the muffler corresponding to section lines II in FIG. 2.

Corresponding to FIGS. 1 and 2, a muffler 1 comprises a housing 2, which envelops a housing interior 3 and which has at least one exhaust gas inlet 4 as well as at least one exhaust gas outlet 5. Exhaust gas is fed through the exhaust gas inlet 4 to the housing interior 3 corresponding to an arrow 6 during the operation of an exhaust system, not shown here, in which the muffler 1 is integrated, or during the operation of an internal combustion engine, not shown here, which is equipped with said exhaust system. By contrast, exhaust gas is removed from the housing interior 3 according to an arrow 7 via the exhaust gas outlet 5 during the operation of the exhaust system or during the operation of the internal combustion engine. The exhaust gas inlet 4 and the exhaust gas outlet 5 are fluidically connected with one another for this in the housing interior 3.

The muffler 1 is designed as an end muffler in the example according to FIGS. 1 and 2. An exhaust pipe connected to the exhaust gas outlet 5 is designed in this case as a tail pipe 8, from which the exhaust gas is discharged into the environment 9 during the operation of the exhaust system or the internal combustion engine. In the example shown, the muffler 1 is installed transversely in a vehicle, of which only a rear-side molding 10, which may also be designated the rear apron 10, can be seen in FIGS. 1 and 2. In case of a transversely installed muffler 1, a central longitudinal axis 11 of the muffler 1 extends transversely, i.e., essentially at right angles to a longitudinal direction 12 of the vehicle, which is indicated by a double arrow in FIGS. 1 and 2. Further, the central longitudinal axis 11 of the muffler 1 extends, as a rule, more or less horizontally.

In the installation situation shown in FIGS. 1 and 2, the muffler 1 is arranged relatively close to the rear molding 10, and there is a relatively short distance between the housing 2 and the rear molding 10 especially in an area 13. As a result, the rear molding 10 is subject to thermal load due to the heat emitted from the housing 2 during the operation of the exhaust system, i.e., during the operation of the internal combustion engine.

At its axial ends, the housing 2 has an end panel 14, 15 each, which axially limit the housing interior 3. The housing 2 has, in addition, a jacket 16, which is arranged extending circumferentially in the circumferential direction 17 of the housing 2. The circumferential direction 17 is indicated by a double arrow in FIG. 2. The jacket 16 forms a radial limitation of the housing interior 3.

As can be seen especially in FIG. 1, at least one chamber 18, through which exhaust gas flows during the operation of the exhaust system, which is indicated by a flow arrow 19, is formed in the housing interior 3. This chamber 18 is axially limited at its axial ends by an intermediate panel 20, 21 each. The two intermediate panels 20, 21 are provided in the example in addition to the end panels 14, 15. Further, the two intermediate panels 20, 21 are located at axially spaced locations from the two end panels 14, 15. An additional chamber 22, which will hereinafter be called an absorption chamber 22, is formed hereby in the housing interior 3 between one end panel, which is arranged at the bottom in FIG. 1, and the adjacent intermediate panel 21. An additional chamber 23, which will hereinafter be called resonance chamber 23, is likewise formed between the other end panel 15, which is arranged at the top in FIG. 1, and the intermediate panel 20 located adjacent to it. The absorption chamber 22 may be optionally filled with an absorption material 24, which has an airborne sound-absorbing effect. A discharge line 25, which has an open inlet end 26 arranged in the chamber 18, is passed through the absorption chamber 22 without interruption. On the outlet side, the discharge line 25 leads to the exhaust gas outlet 5, via which it is fluidically connected with the tail pipe 8. Within the absorption chamber 22, the discharge line 25 has a perforation 27, through which the airborne sound can exit into the absorption chamber 22. The exhaust gas does not flow through the absorption chamber 22 here.

The resonance chamber 23 is connected fluidically to the chamber 18 via a connection pipe 28. Since the resonance chamber 23 is otherwise closed, the exhaust gas likewise does not flow through it during the operation of the exhaust system. The connection line 28 and the resonance chamber 23 form a Helmholtz resonator. The chamber 18 itself, through which exhaust gas can flow, acts as a reflection or expansion chamber, which likewise has a muffling effect.

In addition, the muffler 1 has, in the interior 3 of its housing, at least one insulating shell 29, which is arranged in the area of the chamber 18, through which flow can take place, and extends in the circumferential direction 17 along the jacket 16. The two intermediate panels 20, 21, which axially limit said chamber 18, are supported radially on the insulating shell 29 with a radially outer panel edge 30 and 31, respectively. The respective panel support area of the insulating shell 29 is indicated by a curly bracket each and is designated by 32 in FIG. 1. The insulating shell 29 itself is supported radially with its outer shell edge 33 on the jacket 16. Corresponding jacket support areas are indicated by a curly bracket each and designated by 34 in FIG. 1. Furthermore, the insulating shell 29 is shaped or arranged such that an insulating gap 35 is formed radially between the jacket 16 and the insulating shell 29. The insulating gap 35 is limited by a shell edge 33 at least in the axial direction 36 of the housing 2. The axial direction 36 extends parallel to the central longitudinal axis 11 and is indicated by a double arrow in FIG. 1.

As can be seen in FIG. 1, the shell edge 33 is located at an axially spaced location from the intermediate panels 20, 21 and thus at an axially spaced location from the panel support areas 32 at least in the area of the circumferential sections 41, so that the jacket support areas 34 are also located at axially spaced locations from the panel support areas 32.

The insulating shell 29 is smaller than the jacket 16. The insulating shell 29 is shorter in the axial direction 36 than the jacket 16. The insulating shell 29 is located at an axially spaced location from the two end panels 14, 15 in the example. Furthermore, the insulating shell 29 also has smaller dimensions in the circumferential direction 17 than the jacket 16 in the preferred example shown, so that the insulating shell 29 does not extend over the entire circumference of the housing 2, but it extends over less than 360°. As can be seen in FIG. 2, the insulating shell 29 extends, for example, over less than 120° in the circumferential direction 17. As a result, the two intermediate panels 20, 21 can be supported radially with their respective panel edges 30, 31 on the insulating shell 29 in a shell section 35 assigned to the insulating shell 29 and can be radially supported directly on the jacket 16 in a jacket section 36. Thus, the respective panel edge 30, 31 is formed by the shell section 35 and the jacket section 36 in the respective intermediate panel 20, 21.

In the area of a transition 37 between the shell section 35 and the jacket section 36, the respective intermediate panel 20, 21 may have a step 38. The shell edge 33 can then be passed axially through the respective intermediate panel 20, 21 in the area of this step 38. Such a step 38 is indicated by means of a broken line at the lower intermediate panel 21 in FIG. 1. The step 38 can be seen in FIGS. 2 and 3. The transition 37, which can be seen in FIG. 2 on the left and at the bottom, is shown in an enlarged view in FIG. 3. Since the shell edge 33 can pass through the respective intermediate panel 20, 21 in the area of the step 38 in this mode of construction, it is possible to support the shell edge 33 circumferentially on the jacket 16 in a closed form. This results in a closed, circumferential contact, which is indicated by a broken line in FIG. 1 and is designated by 39.

An alternative embodiment of the transition 37 is indicated in FIG. 1 with a broken line at the upper intermediate panel 20. The shell edge 33 has an interruption 40 in the area of the intermediate panel 20 in this case. The intermediate panel 20 with its jacket section 36 may extend in this interruption 40 up to the jacket 16, so that the intermediate panel 20 will also be supported now radially on the jacket 16 in the area of the shell edge 33. It is clear that a mixed mode of construction may also be embodied, in principle, so that either the two transitions 37 have different shapes in the same intermediate panel 20, 21, or else the transitions 37 have different shapes in the two intermediate panels 20, 21.

If the insulating shell 29 extends over less than 360° in the circumferential direction 17, it is useful to likewise limit the insulating gap 35 in the circumferential direction 17 by a correspondingly shaped shell edge 33. The shell edge 33 according to FIG. 1 has two circumferential sections 41 extending in the circumferential direction 17 and two axially extending axial sections 42 for this purpose. The two axial sections 42 advantageously connect the two circumferential sections 41, so that the shell edge 33 extends in a closed form on the insulating shell 29. Only one such axial section 42 can be seen in FIG. 1. By contrast, two axial sections 42 can be seen in FIG. 2.

Figure 3:
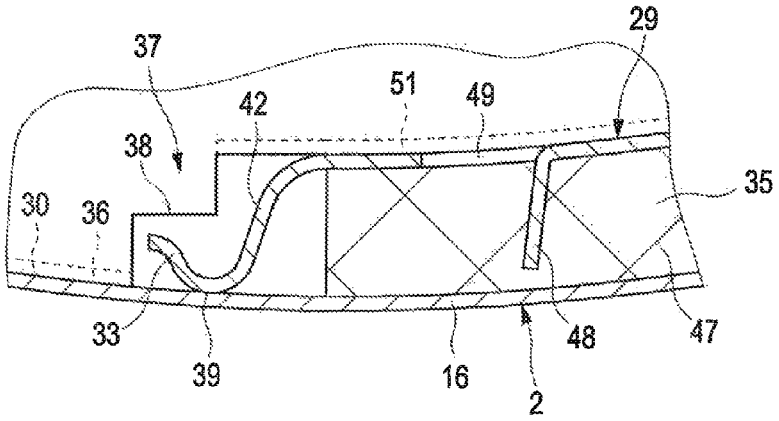
FIG. 3 shows an enlarged detail III from FIG. 2.

As can be seen especially in FIG. 3, the shell edge 33 has a profile in the cross section, which is shaped such that the contact 39 between the shell edge 33 and the jacket 16 is punctiform in profile, while it is linear along the shell edge 33 according to FIG. 1.

According to FIG. 1, the chamber 18, through which flow is possible, is designed, as was mentioned, as a reflection and/or expansion chamber. A feed line 43, through which exhaust gas enters the chamber 18 during the operation of the exhaust system and which has an open outlet end 44, is provided in this case. In addition, the discharge line 25 is provided, through which exhaust gas leaves the chamber 18 during the operation of the exhaust system and which has the open inlet end 26. The feed line 43 is formed by the exhaust gas inlet 4 in the example, so that the exhaust gas inlet 4 opens here into the chamber 18. Further, the exhaust gas inlet 4 opens here into the chamber 18 through the jacket 16.

Further, provisions are made for the exhaust gas inlet 4 to open into the chamber 18 on an opposite side of the jacket 16 in relation to the insulating shell 29. The exhaust gas inlet 4 is preferably aligned with the chamber 18 such that an inflow direction 45 is obtained with which the exhaust gas flows into the chamber 18 during the operation of the exhaust system and which reaches the insulating shell 29. The orientation of the exhaust gas inlet 4 aligned with the insulating shell 29 is indicated in FIG. 2, in addition, by a dash-dotted line 46, which forms an extension of the direction arrow of the inflow direction 45 and which reaches the insulating shell 29.

FIG. 2 shows, in addition, that the exhaust gas inlet 4 is connected to the jacket 16 in the circumferential direction 17 outside the insulating shell 29. In respect to the intermediate panels 20, 21, this means that the exhaust gas inlet 4 is connected to the jacket 16 in the area of the jacket sections 36.

Figure 4:
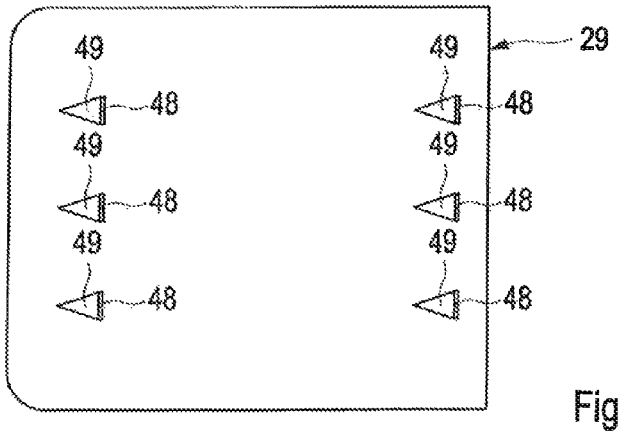
FIG. 4 shows a radial view of an insulating shell of the muffler.

As can be seen in FIGS. 2 and 3, an insulating material 47 may be arranged in the insulating gap 35. The insulating material 47 may be formed in the form of a mat consisting of a suitable, heat-insulating material. The insulating material 47 has a heat-insulating effect and thus reduces the heat transfer between the insulating shell 29 and the jacket 16. The insulating material 47 is advantageously fixed on the insulating shell 29. According to FIGS. 3 and 4, provisions may be made for fixing the insulating material 47 within the insulating gap 35, for fixing sections 48, which mesh with the insulating material 47, to be bent out on the insulating shell 29. Further, these fixing sections 48 are dimensioned such that they do not touch the jacket 16. Due to the bent-out fixing sections 48, the insulating shell 29 contains recesses 49, which are complementary thereto and are formed by bending out the fixing sections 48. The fixing sections 48 are provided with a triangular geometry in the example. To prepare the fixing sections 48, two sides of these triangles are cut free and the particular fixing section cut free is then bent over around the third side. The fixing section 48 mesh with the insulating material 47 in a thorn-like manner, as a result of which this insulating material is fixed sufficiently in its position.

As can be seen in FIG. 1, the end panels 14, 15 advantageously also have a circumferential panel edge 50, via which the end panels 14, 15 are radially supported on the jacket 16. Unlike in the intermediate panels 20, 21, the panel edges 50 are supported, however, in case of the end panels 14, 15 on the jacket 16 in a closed, circumferentially extending form in the circumferential direction 17.

To embody an inexpensive embodiment, the jacket 16 itself has a single-walled design. A locally limited double-walled structure is embodied for the jacket 16 only in the area of the insulating shell 29 in connection with the insulating shell 29.

The insulating shell 29 is advantageously manufactured from a steel plate, preferably a stainless steel plate.

For a simplified assembly, at least the insulating shell 29 and the two intermediate panels 20, 21 may be integrated into a muffler insert or functional insert. The intermediate panels 20, 21 may be welded for this purpose to the insulating shell 29 along the respective shell section 30, 31. After inserting this muffler insert into the jacket 16, which may be performed, in principle, axially, the intermediate panels 20, 21 can be welded to the jacket 16 along their jacket sections 36. A welded connection may likewise be provided between the shell edge 33 and the jacket 16. Said welded connections may be formed by weld seams or by welding spots.

While specific embodiments of the invention have been shown and described in detail to illustrate the application of the principles of the invention, it will be understood that the invention may be embodied otherwise without departing from such principles.

What is claimed is:

1. A muffler for an exhaust system of an internal combustion engine of a motor vehicle, the muffler comprising:

a housing comprising a jacket extending circumferentially in a circumferential direction, a first axial end panel and a second axial end panel;

at least one exhaust gas inlet to the housing;

at least one exhaust gas outlet to the housing;

a first intermediate panel;

a second intermediate panel cooperating with the first intermediate panel to form a chamber, in the housing interior, through which exhaust gas flows during the operation of the exhaust system and which is axially limited by the first intermediate panel, at a first axial end, and by the second intermediate panel, at a second axial end; and at least one insulating shell extending in the circumferential direction along the jacket in the housing interior, wherein:

the first intermediate panel is supported radially on the insulating shell with a first intermediate panel outer panel edge;

the second intermediate panel is supported radially on the insulating shell with a second intermediate panel outer panel edge;

the insulating shell is supported radially on the jacket with a shell edge;

an insulating gap is formed radially between the jacket and the insulating shell;

the insulating shell extends in the circumferential direction over less than 360°;

the insulating shell has a first shell section;

a first panel radial edge of the first intermediate panel is supported at the first shell section;

the insulating shell has a second shell section;

a second panel radial edge of the second intermediate panel is supported at the second shell section;

the jacket has a first jacket section;

a first panel radial edge of the first intermediate panel is supported at the first jacket section;

the jacket has a second jacket section; and a second panel radial edge of the second intermediate panel is supported at the second jacket section.

2. A muffler in accordance with claim 1, wherein the insulating shell is axially spaced from the first axial end panel and is axially spaced from the second axial end panel.

3. A muffler in accordance with claim 1, wherein the insulating shell extends in the circumferential direction over a maximum of 180°.

4. A muffler in accordance with claim 1, wherein the first intermediate panel has a step in which a shell edge passes through the first intermediate panel in an area of at least one transition between the first shell section and the first jacket section.

5. A muffler in accordance with claim 1, wherein the insulating shell has a shell edge with at least one interruption in which the first intermediate panel extends up to the jacket and is supported radially on the jacket in the first jacket section with the panel edge.

6. A muffler in accordance with claim 1, wherein the insulating shell has a shell edge that has two circumferential sections extending in the circumferential direction and two axially extending axial sections, which connect the two circumferential sections to one another.

7. A muffler in accordance with claim 1, wherein the insulating shell has a shell edge that is shaped such that a linear contact is obtained between the shell edge and the jacket.

8. A muffler in accordance with claim 1, wherein:

the at least one exhaust gas inlet is connected to a feed line, through which exhaust gas enters the chamber during the operation of the exhaust system;

the feed line has an open outlet end;

the at least one exhaust gas outlet is connected to a discharge line, through which exhaust gas leaves the chamber during the operation of the exhaust system;

the discharge line has an open inlet end; and the chamber comprises at least one of a reflection chamber and an expansion chamber.

9. A muffler in accordance with claim 1, wherein the at least one exhaust gas inlet opens through the jacket into the chamber.

10. A muffler in accordance with claim 8, wherein the at least one exhaust gas inlet opens into the chamber opposite the insulating shell.

11. A muffler in accordance with claim 1, wherein the at least one exhaust gas inlet passes through the jacket in an area of the jacket sections.

12. A muffler in accordance with claim 1, further comprising insulating material arranged in the insulating gap.

13. A muffler in accordance with claim 11, wherein:

the insulating shell comprises fixing sections, which mesh with the insulating material without touching the jacket; and the fixing sections are bent out on the insulating shell.

14. A muffler in accordance with claim 1, wherein:

the first intermediate panel is welded to the insulating shell;

the second intermediate panel is welded to the insulating shell; and the insulating shell is supported loosely on the jacket.

15. A muffler for an exhaust system of an internal combustion engine of a motor vehicle, the muffler comprising:

a housing comprising a jacket extending circumferentially in a circumferential direction, a first axial end panel and a second axial end panel;

at least one exhaust gas inlet to the housing;

at least one exhaust gas outlet to the housing;

a first intermediate panel;

a second intermediate panel cooperating with the first intermediate panel to form a chamber, in the housing interior, through which exhaust gas flows during the operation of the exhaust system and which is axially limited by the first intermediate panel, at a first axial end, and by the second intermediate panel, at a second axial end; and at least one insulating shell extending in the circumferential direction along the jacket in the housing interior, wherein:

the first intermediate panel is supported radially on the insulating shell with a first intermediate panel outer panel edge;

the second intermediate panel is supported radially on the insulating shell with a second intermediate panel outer panel edge;

the insulating shell is supported radially on the jacket with a shell edge;

an insulating gap is formed radially between the jacket and the insulating shell;

the first intermediate panel is welded to the insulating shell;

the second intermediate panel is welded to the insulating shell; and the insulating shell is supported loosely on the jacket.

* * * * *